US005941236A

United States Patent [19]

Byrne

[11] Patent Number: 5,941,236

[45] Date of Patent: Aug. 24, 1999

[54] ROOFING KETTLE CONTROL APPARATUS

[75] Inventor: Brian T. Byrne, Chanhassen, Minn.

[73] Assignee: Garlock Equipment Company, Minneapolis, Minn.

[21] Appl. No.: 08/782,327

[22] Filed: Jan. 13, 1997

[51] Int. Cl.[6] ..... F23Q 9/08

[52] U.S. Cl. ..... 126/343.5 A; 126/374; 431/25; 431/78; 431/283; 431/71; 431/43; 431/75; 431/73; 431/74; 431/86

[58] Field of Search ..... 431/25, 51, 283, 431/86, 43, 44, 45, 46, 69, 70, 71, 73, 77, 74, 78; 126/343.5 A, 374, 391, 350 R, 351, 116 A, 91 A

[56] References Cited

U.S. PATENT DOCUMENTS

| | | | |
|---|---|---|---|
| 2,830,577 | 4/1958 | Walter, Jr. . | |
| 3,252,655 | 5/1966 | Wollner et al. . | |
| 3,622,257 | 11/1971 | Hein | 431/51 |
| 4,086,048 | 4/1978 | Carlson | 431/46 |
| 4,416,614 | 11/1983 | Moody . | |
| 4,418,681 | 12/1983 | Moody | 126/351 |
| 4,429,682 | 2/1984 | Huang | 126/351 |
| 4,461,615 | 7/1984 | Inoue | 431/76 |
| 4,887,959 | 12/1989 | Shellengerger | 431/51 |
| 5,103,801 | 4/1992 | Herring et al. . | |
| 5,355,841 | 10/1994 | Moore, Jr. et al. . | |
| 5,379,683 | 1/1995 | Ejiri et al. . | |
| 5,575,272 | 11/1996 | Byrne . | |

*Primary Examiner*—Carl D. Price
*Attorney, Agent, or Firm*—Alan Kamrath; Oppenheimer Wolff & Donnelly LLP

[57] ABSTRACT

Roofing kettle apparatus for heating asphalt includes a wheeled chassis mounting a vat and a heating system for heating the vat. The heating system includes a solenoid operated valve for controlling the flow of fuel gas from a fuel gas source to each of a pair of burner nozzles and a igniter assembly having an outlet adjacent the outlet of a first combustion chamber. An igniter generates a spark to ignite gas discharging from the igniter assembly outlet. A flame sensor adjacent to the first combustion chamber outlet end senses the burning of fuel gas. The igniter assembly has a second outlet adjacent the second combustion chamber outlet end. The ignition of fuel gas discharging from the igniter assembly ignites the gas discharging through the combustion chamber outlets. The burners extend into the combustion chambers. Electric controls include circuitry in the igniter and a temperature controller to energize and deenergize the valve and generate a spark a number of times with a time delay between each energization and deenergization to purge gas in the combustion chambers in the event the flame sensor does not sense a flame after the respective energization and to control the range of temperatures to which the material in the vat is heated.

15 Claims, 2 Drawing Sheets

ROOFING KETTLE CONTROL APPARATUS

(1) FIELD OF THE INVENTION

This invention relates to roofing kettles, and particularly to a control system for controlling the heating of roofing material such as asphalt in roofing kettles.

(2) DESCRIPTION OF THE PRIOR ART

In U.S. Pat. No. 5,575,272 to Byrne, there is disclosed a kettle housing mounted on a wheeled chassis together with a control system for controlling the temperature in the asphalt vat. The control system includes a spark igniter and a thermocouple that emits an activation signal when fuel gas has been ignited and significant heat is being produced. Further, the control system includes controls for starting and stopping the flow of gas for maintaining the temperature of asphalt within a desired temperature range.

U.S. Pat. No. 4,416,614 to Moody discloses an asphalt heating kettle wherein an electric igniter is disposed in front of a pilot burner with the pilot burner being opposite the main burner from the burner flue. A thermocouple is provided to sense the presence of a pilot flame and in the absence of a flame, gas flow to the pilot burner and main burner is turned off.

In roofing kettles using thermocouples of the type that sense heat and that directly or indirectly control the flow of fuel gas to the combustion chambers, in the event the flame in the combustion chamber should go out and the temperature in the vat is below the range of the desired operating range of temperatures that the material in the vat is to be kept, the loss of heat adjacent to the combustion chambers may not be sufficiently fast to stop the flow of fuel gas to the burner nozzles before a considerable amount of unburnt fuel gas is discharged into the kettle housing. This is undesirable.

In order to provide an improved control system for roofing kettles, for example, ones such as disclosed in the above patents, this invention has been made.

SUMMARY OF THE INVENTION

The present invention relates to a control system for controlling the flow of fuel gas from a solenoid operated control valve that is operable between an "on" position to start the flow of fuel gas to a pair of burners and an igniter assembly at the same time and an "off" position to stop such flow. The igniter assembly includes a T-shaped fitting having an inlet and outlets adjacent to the respective one of the pair of combustion chamber outlet ends. A spark igniter is mounted adjacent to one of the combustion chambers and one of the igniter assembly fitting outlets to ignite gas that is being discharged from the igniter assembly cross tube which in turn ignites the fuel gas being discharged into the adjacent combustion chamber from a fuel nozzle. A flame sensor is mounted adjacent the outlet of a combustion chamber to sense the ions generated by the burning gas. Upon the control system being actuated, the control system automatically operates the igniter and the fuel gas control valve to supply gas to the igniter assembly and to make up to three attempts to ignite the gas flowing into the combustion chamber with appropriate delays between each attempt before requiring the operator to restart the process for starting the heating operation.

One of the objects of this invention is to provide new and novel control means for sensing the presence of a flame at the outlet of a roofing kettle combustion chamber and in the event such a flame is not sensed within a preset time delay, discontinue the supply of fuel gas to the combustion chamber and igniter assembly. Another object of this invention is to provide in control means for a roofing kettle, new and novel means, that upon initially operating the controls to start heating the kettle, will provide an ignition spark and fuel gas at the kettle combustion chamber for up to a preselected number of times, with a time delay between each attempt for purging of fuel gas in the chamber between each attempt in the event the fuel gas is not ignited, before the operator has to restart the ignition procedure.

DETAILED DESCRIPTION

Figure 1:
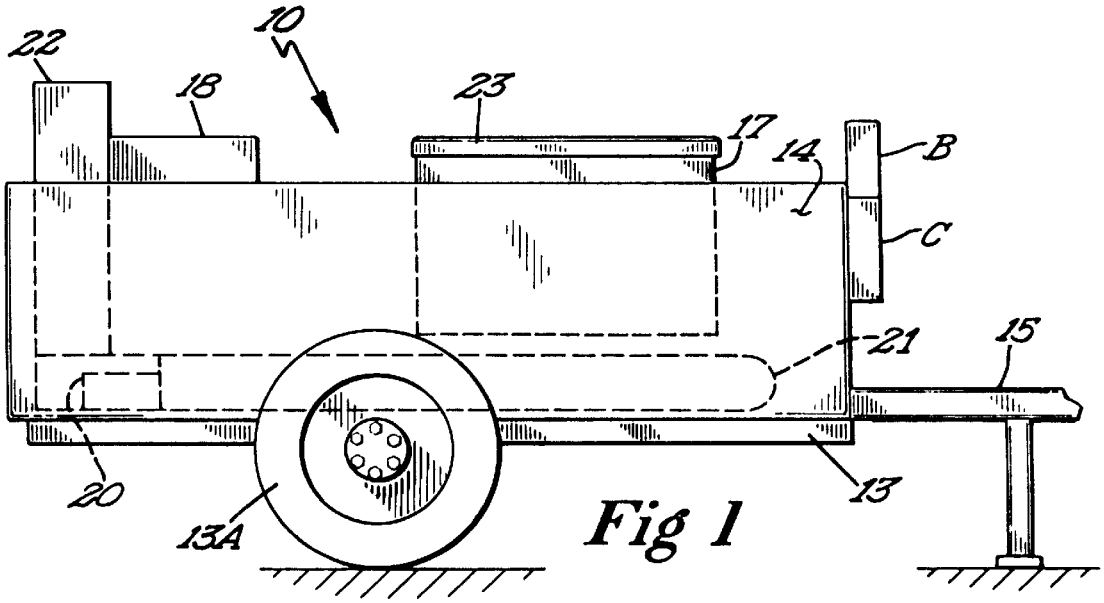
FIG. 1 is a somewhat diagrammatic side view of a portable roofing kettle apparatus.
Figure 3:
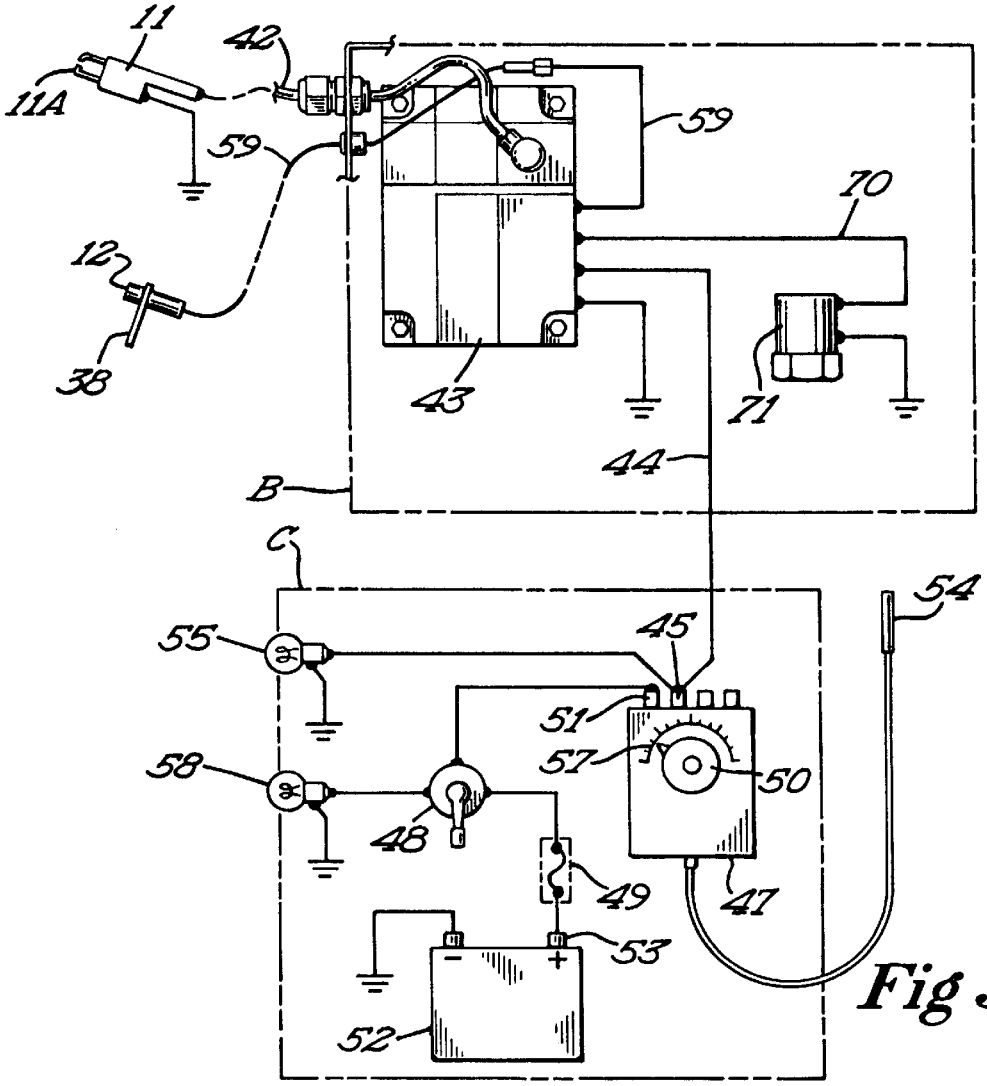
FIG. 3 is a schematic showing of the control system for regulating the flow of fuel gas to the heating system and igniting the fuel gas.
Figure 2B:
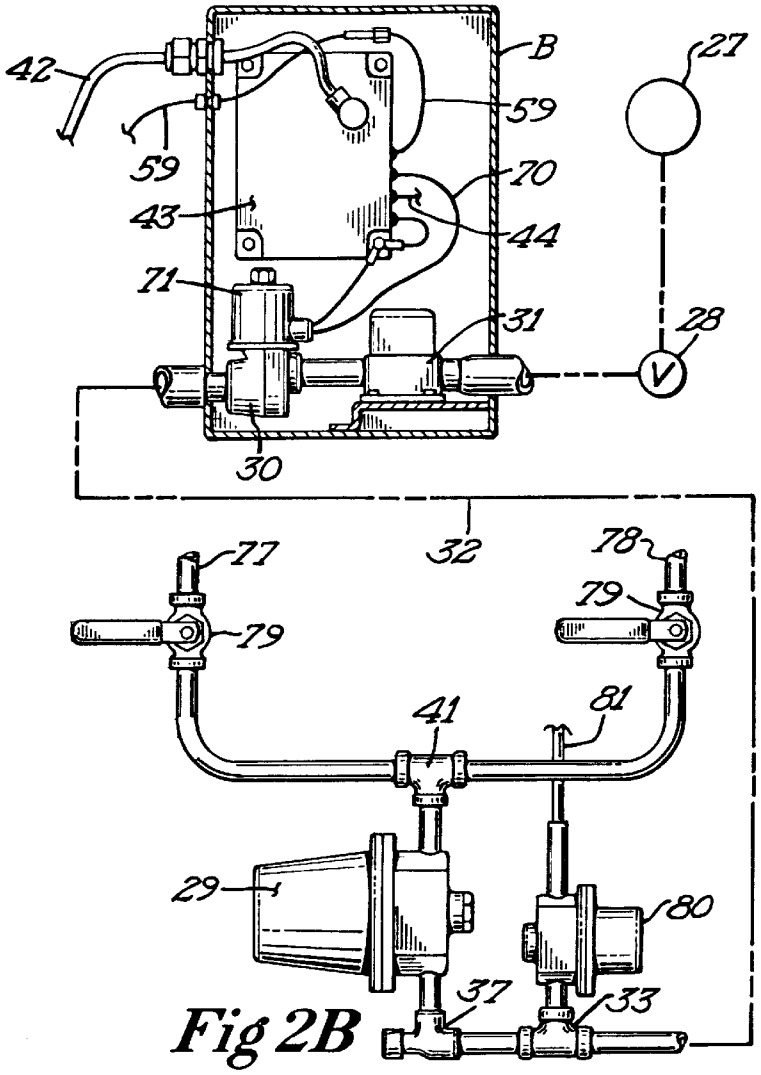
FIGS. 2A and 2B are a somewhat diagrammatic showing of the heating system for the roofing kettle apparatus of FIG. 1 with various parts being broken away.
Figure 2A:
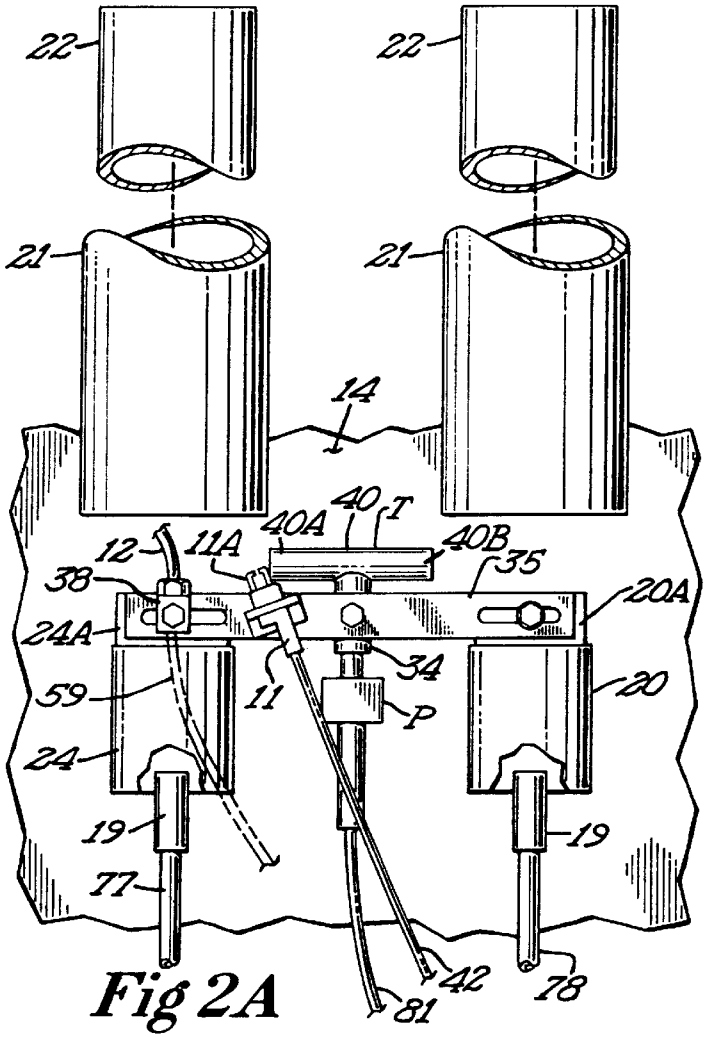

The roofing kettle apparatus of FIG. 1, generally designated 10, may be of the general type disclosed in U.S. Pat. No. 5,575,272 other than for the modification of controls, including the location and type of the igniter 11 and the flame sensor 12. The kettle apparatus 10 includes a wheeled chassis 13 with wheels 13A mounting a kettle housing 14 and with a hitch 15 for being attached to the chassis to facilitate towing the kettle apparatus from place to place.

Within the kettle housing, there is provided a vat 17 for containing asphalt that is to be heated, an open top well 18 in which the two main burner nozzles 19 and combustion chambers 20 and 24 are located and fuel arrays 21 through which the hot combustion gases from the combustion chambers are circulated to heat the material in the vat prior to the combustion gases being discharged to the ambient atmosphere through the flues 22. The inlet ends of the fuel arrays are adjacent to the outlet ends 20A and 24B respectively of the combustion chambers. A cover 23 is provided for selectively closing the open top vat.

The fuel array includes a series of pipes, only partially shown, that extend in relationship to the vat for heating the material therein. To provide heated gases, a source of pressurized fuel gas 27, for example LP gas in cylinders, is fluidly connected through a shutoff cock 28 and thence through a filter 31 to a solenoid operated control valve 30 that, when its solenoid coil 71 is energized, is operated to an "open"position to permit the fuel gas to flow therethrough, and when deenergized, returns to its normally closed position to block the flow of fuel gas therethrough. The solenoid valve in turn is fluidly connected by a line 32 to the inlet end of the T-joint while one outlet end of the joint is connected through fittings 37 to a high pressure regulator 29. The outlet of regulator 29 is fluidly connected to the inlet end of the T-joint 41. The outlet ends of joint 41 are fluidly connected by lines 77 and 78 to burner nozzles 19. A shutoff valve 79 is provided in each of the lines 77 and 78.

The burner nozzles extend adjacent to the inlet ends of the combustion chambers or into the combustion chambers 20 and 24 whereby, as fuel gas is discharged under high pressure from the nozzles, the fuel gas is mixed with air. The bracket 35, which mounts the combustion chambers, is mounted to and within the kettle housing.

When the fuel gas air mixture in the combustion chambers is ignited, the hot gases are discharged into the inlet ends of the adjacent fuel arrays 21. The hot gases in the fuel arrays circulate through and/or adjacent to the vat to heat and/or maintain the asphalt in a heated condition within a desired temperature range. To ignite the fuel gas in the combustion chambers, an igniter assembly P has opposite outlet ends 40A and 40B of the cross tube 40 of the T-fitting T opening adjacent to the discharge ends 24A and 20A respectively of the combustion chambers while the spark igniter 11 is mounted to bracket 35 to ignite the fuel gas discharging from the outlet end 40A. The spark igniter has two opposed electric leads which are spaced apart to form a spark gap 11A to produce a spark when an electric current is applied to the spark igniter from the spark box 43. When fuel gas is discharging from the cross bar adjacent to combustion chamber 24 and is ignited, a flame flashes through the cross tube to ignite the fuel gas mixture discharging from outlet 40B to ignite the gas discharging from combustion chamber 20.

To provide fuel gas to the cross tube 40, a second outlet of the T-joint 33 is fluidly connected to the inlet of a low pressure regulator 80 while the regular outlet is fluidly connected by a conduit 81 to the inlet end 34 of the T-shaped fitting T. Usually the pressure regulators are adjusted to apply fuel gas at the nozzle burners under a much higher pressure than the pressure of the gas applied to the igniter assembly, for example about 24–35 psi to the burners and up to about 10 psi at the igniter assembly. To sense when the fuel gas air mixture in combustion chamber 24 has been ignited, the flame sensor 12 is mounted by a bracket 38 to bracket 35 to be adjacent to the discharge end of combustion chamber 24. The flame sensor, in conjunction with a circuit (not shown) in the temperature controller 47, is of a conventional type that senses the presence of the light of a flame through a process known as flame rectification as contrasted to sensing heat. The flame sensor and temperature controller are of conventional designs, for example ones manufactured by Kidde-Fenwal, Inc. and Robertshaw, Inc., respectively.

For conducting current to produce a spark at the igniter spark gap 11A, a lead 42 electrically connects the spark igniter to the spark box 43 in the igniter box B. The spark igniter may be of a conventional type, for example one manufactured by Kidde-Fenwal, Inc. The igniter box B and the controller box C are mounted to the exterior of the kettle housing in a convenient location such as shown in FIG. 1.

The circuitry (not shown) in the spark box is connected by a lead 44 to a terminal 45 of an adjustable temperature controller 47 in the controller box C while a manually operated on-off switch 48 and a fuse 49 are connected in series across a second terminal 51 of the temperature controller and a terminal 53 of the battery 52. The second battery terminal is connected to ground. At least one thermocouple 54, which is connected to the controller, is positioned in, or adjacent to, the vat to sense the temperature of the asphalt in the vat. The temperature controller 47 includes a control knob 50 that is rotatable for selectively varying the desired temperature to which the vat material is to be heated. Suitable indicia 57 is provided adjacent to knob 50 to indicate the selected operating temperature of the vat.

A blue "ready" light 55 is connected to terminal 45 to be illuminated for indicating fuel gas is burning or should be burning at the burners while a green power light 58 is connected to switch 48 for being illuminated when the power switch 48 is in its "on" position.

A lead 59 electrically connects the flame sensor 12 to the spark box 43 while a lead 70 is connected across the solenoid coil 71 of the solenoid valve 30 and the spark box to control the energization of the solenoid coil 71 which in turn controls the flow of fuel gas between the source 27 and the burner nozzles and the igniter assembly, provided the stop cock and the shutoff valves 79 are open.

With cold asphalt in the vat and the stop cock 28 and shutoff valves 79 in an open condition, the switch 48 is turned to its "on"position to apply power to the spark box 43 and the temperature controller. The spark box contains internal circuitry (not shown) for energizing the solenoid coil 71 to operate the solenoid valve 30 to its open condition and, with a time delay of a few seconds, for example about four seconds, for fuel gas to flow to the igniter assembly and the outlet ends of the combustion chamber, apply a current to the spark igniter 11 to produce a spark at a spark gap 11A. This ignites the fuel gas mixture at the outlet ends of the cross tube 40 and the flame at the outlet ends in turn ignite the fuel gas being discharged at the outlet ends of the combustion chambers. Upon the flame sensor 12 being activated by sensing the ions generated by the burning of fuel gas in combustion chamber 24, a signal is sent to the temperature controller and the spark box to indicate the fuel gas mixture is ignited. The ignition of fuel gas discharging from the igniter assembly does not activate the flame sensor and the generation of a spark by the spark igniter does not ignite the fuel gas being discharged from combustion chamber 24. Thus, outlet 40A is sufficiently spaced from the outlet of the combustion chamber 24 so that fuel gas discharging from the combustion chamber does not blow out the flame at the outlet 40A, but the flame at outlet 40A will ignite the fuel gas discharging from the combustion chamber 24.

The spark box circuitry then retains the solenoid valve 30 in its energized condition until the thermocouple 54 acting through the temperature controller sends a signal to the spark box for deenergizing the solenoid coil 71, or the flame sensor, no longer sensing a flame at the combustion chamber 24, acts through the spark box circuitry to deenergize the solenoid coil. This results in the discontinuance of fuel gas flow to the igniter assembly and the burner nozzles.

Upon the thermocouple sensing that the temperature of the asphalt has fallen below the preselected temperature range, a circuit (not shown) in the temperature controller sends a signal to the spark box to energize the solenoid coil again and provide spark at the spark gap in the manner described with reference to the initial ignition of the fuel gas mixture that is then exiting from the combustion chambers.

In the event that a spark is provided at the spark gap 11A and the flame sensor does not sense the existence of a flame at combustion chamber 24 upon the end of a preset time delay in the spark box circuit, the spark box opens a circuit to deenergize the solenoid valve and thereby discontinue the supply of fuel gas to the igniter assembly and the burner nozzles. Then, the spark box circuitry provides a sufficient time delay for the fuel gases in the combustion chambers to self purge and thence automatically reenergizes the solenoid valve whereby fuel gas is again supplied to the combustion chambers and the inlet of the igniter assembly. When fuel gas is again being supplied, the spark box completes a circuit to generate a spark at the spark gap 11A. If the gas mixture in the combustion chambers is ignited such as sensed by the flame sensor, the solenoid valve remains in its open condition until the temperature sensor senses the temperature in the vat is at the top end of or within the desired temperature range.

In the event the flame sensor does not sense a flame within a predetermined time, for example about 10 seconds, after the on-off switch is manually moved to its "on" position, the solenoid valve has been energized (operated to its open position) and a spark has been generated at the spark gap 11A, the spark box circuitry deenergizes the solenoid valve for a predetermined time which is sufficient for fuel gas to self purge from the combustion chambers.

Then the spark box circuitry automatically energizes the solenoid valve a second time and generates a spark such as above set forth.

If the fuel gas air mixture in combustion chamber 24 is not ignited after the second attempt, the series of occurrences referred to in the preceding paragraph are automatically repeated. However, if ignition of fuel gas does not take place (not sensed by the flame sensor) after the third attempt, the spark box circuitry will not initiate a further attempt to cause ignition until the on-off switch is turned to its "off" position and again turned to its "on" position. This provides a safety feature.

By using a flame sensor 12, in the event the flame at combustion chamber 24 should go out, the supply of fuel gas to the combustion chambers would be discontinued in that the solenoid valve is deenergized. When the temperature is sensed by a temperature sensor, there may be a considerable time delay before the solenoid valve is deenergized as there may be a delay in the temperature adjacent the temperature sensor dropping sufficiently that the circuitry reacts to discontinue the supply of fuel gas to the combustion chambers.

In the event it is desired to have combustion take place in only one combustion chamber, only the shutoff valve 79 in line 77 is opened prior to moving the on-off switch to its "on" position.

It is to be understood that the control means may include additional thermocouples and circuitry (not shown), for example to sense the temperature in the vat rising close to or beyond a safe level and act through circuitry in the temperature controller and the spark box to stop the flow of fuel gas to the fuel nozzles such as disclosed in U.S. Pat. No. 5,575,272.

What is claimed is:

1. Roofing kettle apparatus, comprising, in combination: a chassis, a vat mounted on the chassis for containing asphalt and heating means mounted to the chassis for heating the asphalt contained in the vat, said heating means including a combustion chamber for having fuel gas burnt therein to provide a hot gas mixture, said combustion chamber having an outlet end and an inlet end, a burner adjacent to the combustion chamber inlet end to discharge fuel gas into the combustion chamber for being combusted, igniter means for generating a spark to ignite fuel gas in the combustion chamber, gas circulation means for conveying the hot gas mixture from the combustion chamber to adjacent the vat for heating the vat, a pressurizing source of fuel gas, a solenoid operated valve operative between an energized open condition to permit gas flow from the fuel gas source to the burner and a deenergized closed condition for blocking the flow of fuel gas from the fuel gas source to the burner, said solenoid operated valve fluidly connecting the fuel gas source to the burner, a flame sensor means mounted adjacent to the combustion means outlet end for sensing the ions generated by the burning of fuel gas and thereupon generating a signal, an electric power source, and electric control means interconnected between the igniter means, the flame sensor means and the solenoid operated valve for selectively operating the solenoid operated valve to its open position and within a predetermined time delay, for applying a current to the igniter means to generate a spark and for maintaining the solenoid operated valve in its open position beyond a predetermined time delay subsequent to the solenoid operated valve being operated to its open position only in the event a flame is sensed by the flame sensor means and deenergize the solenoid operated valve in the event no flame is sensed.

2. The kettle apparatus of claim 1 wherein the chassis is mounted on wheels for movement from one location to another.

3. The kettle apparatus of claim 1 wherein the heating means includes an igniter assembly having an outlet adjacent to the igniter means to have fuel gas discharging through the igniter assembly outlet ignited by the spark generated by the igniter means and thereby ignite fuel gas discharging through the combustion chamber outlet end and an inlet fluidly connected to the solenoid operated valve to have fuel gas flowing thereinto only when the solenoid operated valve is energized.

4. The kettle apparatus of claim 1 wherein the heating means includes a second combustion chamber having an inlet end and an outlet end, a second burner mounted adjacent to the second combustion chamber inlet end to discharge fuel gas under high pressure into the second combustion chamber for being combusted to produce a hot gas mixture, second gas circulation means for conveying the hot gas mixture from the second combustion chamber to adjacent to the vat for heating the vat, means fluidly connected to the solenoid operated valve for providing fuel gas flow from the solenoid operated valve in its open position to adjacent to the igniter means for being ignited by the spark and thereby ignite the fuel gas being discharged from the second combustion chamber outlet end.

5. The kettle apparatus of claim 4 wherein the providing means has an inlet fluidly connected to the solenoid operated valve for having fuel gas flow thereinto when the solenoid operated valve is in its open position, a first outlet adjacent to the first combustion chamber outlet end and a second outlet adjacent to the second combustion chamber outlet end in a remotely spaced relationship to the providing means first outlet, the providing means outlets discharging fuel gas toward the adjacent combustion chamber outlet end when fuel gas flows into the providing means inlet, the igniter means includes an igniter having a spark gap adjacent to the providing means first outlet and the first combustion chamber to provide a spark to ignite fuel gas flowing through the providing means first outlet and the flame sensor means being mounted adjacent to the first combustion chamber and in a remotely spaced relationship to the second combustion chamber outlet end.

6. The kettle apparatus of claim 5 wherein the providing means comprises a T-shaped fitting that has a cross tube having the providing means outlets and a temperature sensor is mounted adjacent to the vat for sensing the temperature of the asphalt therein and the electric control means includes a temperature controller electrically interconnected between the power source, the temperature sensor and the igniter means for acting in cooperation with the igniter means to permit the igniter means energizing the solenoid operated valve when the temperature at the vat is below a preselected range and to deenergize the solenoid operated valve when the temperature is within the preselected range.

7. The kettle apparatus of claim 1 wherein the igniter means includes a spark igniter defining a spark gap and a spark box having a circuitry for controlling the energization and deenergization of the solenoid operated valve and the generation of a spark across the spark gap, the electric control means includes a temperature sensor adjacent the vat to sense the temperature in the vat, a temperature controller having the temperature sensor operatively connected thereto and being electrically connected between the power source and the spark box to signal the spark box to deenergize the solenoid operated valve when the vat is heated to a preselected temperature and to energize the solenoid operated valve when the temperature in the vat falls below a preselected temperature.

8. The kettle apparatus of claim 7 wherein the spark box includes circuitry means for energizing the solenoid operated valve a second time after a time delay to purge fuel gas from the combustion chamber and for activating the spark igniter to generate a spark a second time in the event the solenoid operated valve had been deenergized as the result of no flame being sensed by the flame sensor means after the first energization of the solenoid operated valve.

9. The kettle apparatus of claim 8 wherein the electric control means includes an on-off switch connected in series between the power source and the temperature controller that is movable between an "on" position to energize the igniter means and the temperature controller and an "off" position to deenergize the igniter means and the temperature controller, and the circuitry means and the flame sensor means coact to deenergize the solenoid operated valve the second time in the event no flame is sensed by the flame sensor means within a predetermined time delay after the solenoid operated valve is energized the second time, and in the event the solenoid operated valve is deenergized the second time, after another time delay for purging of fuel gas from the combustion chamber, energizes the solenoid operated valve and activates the igniter means a third time, and in the event no flame is sensed by the flame sensor means the third time, blocks further energization of the solenoid operated valve until the on-off switch is manually moved to its "off" position and then to its "on" position.

10. Roofing kettle apparatus, comprising, in combination: a chassis, a vat mounted on the chassis for containing asphalt and heating means mounted to the chassis for heating the asphalt contained in the vat, said heating means including a combustion chamber for having fuel gas burnt therein to provide a hot gas mixture, said combustion chamber having an outlet end and an inlet end, a burner adjacent to the combustion chamber inlet end to discharge fuel gas into the combustion chamber for being burnt, igniter means for generating a spark, gas circulation means for conveying the hot gas mixture from the combustion chamber to adjacent the vat for heating the vat, a pressurized source of fuel, a solenoid operated valve operative between an energized open condition to permit gas flow from the fuel gas source to the burner and a deenergized closed condition for blocking the flow of fuel gas from the fuel gas source to the burner, a flame sensor mounted adjacent to the combustion chamber for sensing the burning of fuel gas, an igniter assembly having an outlet adjacent to the igniter means for having gas discharging therethrough ignited by a spark and an inlet fluidly connected to the solenoid operated valve for conducting fuel gas to the igniter assembly outlet when the solenoid operated valve is energized, an on-off switch manually movable between an "on" position and an "off" position, and electric control means interconnected between the on-off switch, the igniter means, the solenoid operated valve and the flame sensor for, upon the on-off switch being moved to its "on" position, energizing the igniter means, for energizing the solenoid operated valve, for generating the spark to ignite the fuel gas at the igniter assembly outlet and thereby ignite the fuel gas at the combustion chamber and, in the event there is no sensing by the flame sensor of the fuel gas being ignited within a predetermined time delay after the solenoid operated valve is first energized, for energizing the solenoid operated valve and, after a time delay from the deenergizing of the solenoid operated valve for purging of fuel gas from the combustion chamber, repeat energizing the solenoid operated valve and generating the spark and deenergizing the solenoid operated valve a preselected number of times to ignite the fuel gas, and if the fuel gas is not ignited after each of said number of times with time delays after each time the solenoid operated valve is deenergized and before the solenoid operated valve is again energized, for retaining the solenoid operated valve in a deenergized condition until the on-off switch is turned "off" and then moved to its "on" position.

11. The kettle apparatus of claim 10 wherein the electric control means includes a temperature sensor mounted adjacent to the vat for sensing the temperature of the asphalt in the vat and a temperature controller electrically connected between the on-off switch and the igniter means for, when the on-off switch is in its "on" position, signaling the igniter means to energize the solenoid operated valve when the temperature sensor senses the vat temperature has fallen from a temperature within a preselected temperature range to a temperature being below said temperature range.

12. The kettle apparatus of claim 11 wherein the electric control means includes an electric power source and the on-off switch is connected in series between the temperature controller and the electric power source and the heating means includes a second combustion chamber having an inlet end and an outlet end, a second burner mounted adjacent to the second combustion chamber inlet end to discharge fuel gas under high pressure into the second combustion chamber for being burnt to produce a hot gas mixture, second gas circulation means for conveying the hot gas mixture from the second combustion chamber to adjacent to the vat for heating the vat, the igniter assembly including a second outlet adjacent to the second combustion chamber outlet end for igniting fuel gas being discharged therethrough and the spark generated adjacent to the igniter assembly first outlet and the flame sensor located adjacent to the first combustion chamber outlet end and remote from the igniter assembly second outlet and the second combustion chamber outlet end.

13. The kettle apparatus of claim 11 wherein the heating means includes a source of fuel gas under high pressure, a first pressure regulator is fluidly connected between the solenoid operated valve and the burner and a second pressure regulator is fluidly connected between the solenoid operated valve and the igniter assembly inlet to apply fuel gas to the igniter assembly at a much lower pressure than is applied to the burner.

14. Roofing kettle apparatus, comprising, in combination: a chassis, a vat mounted on the chassis for containing material and heating means mounted to the chassis for heating the material contained in the vat, said heating means including a combustion chamber for having fuel gas burnt therein to provide a hot gas mixture, said combustion chamber having an outlet end and an inlet end, a burner adjacent to the combustion chamber inlet end to discharge fuel gas into the combustion chamber for being combusted, an igniter assembly having an inlet and a first outlet to discharge fuel gas adjacent to the combustion chamber outlet end for, when ignited, igniting the fuel gas discharging from the combustion chamber outlet end, igniter means for generating a spark to ignite fuel gas discharging from the igniter assembly outlet, gas circulation means for conducting the hot gas mixture from the combustion chamber to adjacent the vat for heating the vat, a high pressure source of fuel gas, a high pressure regulator having an inlet and an outlet for discharging fuel gas under high pressure, conduit means for fluidly connecting the high pressure regulator outlet to the burner, a low pressure regulator having an inlet and an outlet fluidly connected to the igniter assembly inlet for conducting fuel gas thereto at a much lower pressure than the pressure of the fuel gas conducted to the burner, a solenoid operated valve operative between an energized open condition to permit flow of fuel gas from the high pressure source to the conduit means and the low pressure regulator inlet and a deenergized closed condition for blocking the flow of fuel gas from the high pressure fuel gas source to the high and low pressure regulators, sensor means mounted adjacent to the combustion chamber means outlet end for sensing gases being burnt at the combustion chamber outlet end and thereupon generating a signal, an electric power source, and electric control means interconnected between the igniter means, sensor means and the solenoid operated valve for operating the solenoid operated valve to its open condition and within a predetermined delay, for applying a current to the igniter means to generate the spark to ignite the fuel gas discharging from the igniter assembly outlet and for maintaining the solenoid operated valve in its open condition for a sufficient period of time for the ignited fuel gas at the igniter assembly outlet to ignite the fuel gas discharging from the combustion chamber outlet end.

15. The kettle apparatus of claim 14 wherein the heating means includes a second combustion chamber having an inlet end and an outlet end, a second burner mounted adjacent to the second combustion chamber inlet end to discharge fuel gas under high pressure into the second combustion chamber for being burnt to produce a hot gas mixture, the second burner being fluidly connected to one of the high pressure regulator and the conduit means, second gas circulation means for conducting the hot gas mixture from the second combustion chamber to adjacent the vat for heating the vat, the igniter assembly having a second outlet remote from the igniter assembly first outlet and adjacent to the second combustion chamber outlet end to ignite the fuel gas discharging from the second combustion chamber outlet end when the fuel gas discharging from the igniter assembly first outlet is ignited.

* * * * *